US009850730B2

(12) United States Patent
Moya et al.

(10) Patent No.: US 9,850,730 B2
(45) Date of Patent: Dec. 26, 2017

(54) RAM BLOWOUT PREVENTER PISTON ROD SUBASSEMBLY

(71) Applicant: Hydril USA Distribution, LLC, Houston, TX (US)

(72) Inventors: Ronny Alexander Moya, Houston, TX (US); Richard Lee Stringfellow, Houston, TX (US); Brian Scott Baker, Houston, TX (US)

(73) Assignee: Hydril USA Distribution, LLC, Houston, TX (US)

( * ) Notice: Subject to any disclaimer, the term of this patent is extended or adjusted under 35 U.S.C. 154(b) by 340 days.

(21) Appl. No.: 14/801,234

(22) Filed: Jul. 16, 2015

(65) Prior Publication Data

US 2016/0017685 A1 Jan. 21, 2016

Related U.S. Application Data

(60) Provisional application No. 62/025,700, filed on Jul. 17, 2014.

(51) Int. Cl.
*E21B 33/06* (2006.01)

(52) U.S. Cl.
CPC ..... *E21B 33/062* (2013.01)

(58) Field of Classification Search
CPC ..... E21B 33/061; E21B 33/062
See application file for complete search history.

(56) References Cited

U.S. PATENT DOCUMENTS 4,052,995 A * 10/1977 Ellison ..... E21B 33/062 137/1
4,076,208 A * 2/1978 Olson ..... E21B 33/062 251/1.3
4,188,860 A * 2/1980 Miller ..... F15B 15/261 92/15
4,290,577 A * 9/1981 Olson ..... E21B 33/062 251/1.3

(Continued)

FOREIGN PATENT DOCUMENTS

CN 201730579 U 2/2011

OTHER PUBLICATIONS

PCT Search Report and Written Opinion issued in connection with corresponding Application No. PCT/US2015/040823 dated Jan. 28, 2016.

*Primary Examiner* — Robert E Fuller
(74) *Attorney, Agent, or Firm* — Hogan Lovells US LLP

(57) ABSTRACT

A piston rod subassembly for use in a blowout preventer operator assembly includes a piston rod having a rod threaded interface and a rod shoulder on an outer diameter of the piston rod. A preload ring has a ring threaded interface for engaging the rod threaded interface to couple the piston rod to the preload ring. A protruding end surface of the piston rod protrudes past an end face of the preload ring when the piston rod is coupled to the preload ring and the rod shoulder engages a ring shoulder of the preload ring. A piston has a pocket for receiving the preload ring. Preload ring fasteners couple the preload ring to the piston to form a piston rod connection between the piston rod and the piston, such that the protruding end surface engages an interior surface of the pocket and a preload is induced in the piston rod connection.

20 Claims, 3 Drawing Sheets

(56) References Cited

U.S. PATENT DOCUMENTS

| | | | | |
|---|---|---|---|---|
| 4,437,643 | A * | 3/1984 | Brakhage, Jr. | E21B 33/062 251/1.3 |
| 5,025,708 | A * | 6/1991 | Smith | E21B 33/062 92/19 |
| 6,006,647 | A | 12/1999 | Van Winkle | |
| 7,195,224 | B2 * | 3/2007 | Le | E21B 33/062 251/1.3 |
| 7,300,033 | B1 * | 11/2007 | Whitby | E21B 33/062 166/85.4 |
| 7,699,554 | B2 | 4/2010 | Hemphill et al. | |
| 7,798,466 | B2 * | 9/2010 | Springett | E21B 33/062 166/85.4 |
| 7,832,480 | B1 | 11/2010 | Fanguy | |
| 7,832,706 | B2 | 11/2010 | Judge | |
| 8,857,784 | B2 * | 10/2014 | Shimonek | F15B 15/261 166/323 |
| 2014/0166264 | A1 | 6/2014 | Judge et al. | |

* cited by examiner

RAM BLOWOUT PREVENTER PISTON ROD SUBASSEMBLY

CROSS REFERENCE TO RELATED APPLICATIONS

This application claims priority to and the benefit of U.S. Provisional Application Ser. No. 62/025,700 filed Jul. 17, 2014, titled "Ram Blowout Preventer Operator Piston Rod Subassembly" the full disclosure of which is hereby incorporated herein by reference in its entirety for all purposes.

BACKGROUND

1. Field of the Disclosure

This disclosure relates generally to blowout preventers used in hydrocarbon drilling and production operations. In particular, the disclosure relates to systems and methods to facilitate assembly, disassembly and on-site maintenance of a piston rod subassembly of a blowout preventer.

2. Description of Related Art

In hydrocarbon drilling and production operations, blowout preventers can be used to block the flow of fluids through a wellbore by having rams that close across the wellbore. The rams can either seal an empty wellbore, or seal the wellbore around a drillpipe, polished rod, or other tools or equipment that is within the wellbore. The ram may alternately be a shear ram, which, when activated, moves to engage and physically shear any member in the wellbore. The rams can alternately be gripping rams that can engage the tubular, polished rod, or other equipment in the well to prevent axial or rotational movement of such tubular, polished rod, or other equipment in the well.

The piston rod subassembly of some current blowout preventers can be a single member with both a piston rod and tail rod that are fully formed of expensive alloys to achieve the desired strength of the piston rod, as the rams and piston rods can be subjected to significant forces and an extreme environment during operation of the blowout preventer.

In some current systems where the piston rod assembly is formed of multiple members, the connection between the members can be preloaded so that the members do not work loose during operation of the blowout preventer. However, the preload on the connection between the members of such current systems requires that the components be sent off-site in order to separate the members for repair, replacement, or salvage.

SUMMARY OF THE DISCLOSURE

Embodiments of this disclosure provide a piston rod subassembly for use in a subsea or surface blowout preventer that allows for a simplified assembly and disassembly process that can take place on site, improving the ability to make repairs and salvage parts. Systems and methods described herein also save on material costs compared to some current piston rod assemblies that have piston rod subassemblies fully formed of expensive alloys. The piston rod assembly described herein provides the piston rod as a separate member so that the piston can be formed of a less costly material.

Systems and methods described herein also provide for a preloaded piston rod connection that does not require a fixture for assembly or disassembly since preload is induced when the preload ring fasteners are secured with a hand tool. The preload can be broken directly during disassembly by removing preload ring fasteners with the hand tool. This allows for repairs to be made on site, such as offshore, and makes it easier to salvage parts without additional operations such as machining.

In an embodiment of this disclosure, a piston rod subassembly for use in a blowout preventer includes a piston rod having a rod threaded interface and having a rod shoulder on an outer diameter of the piston rod. A preload ring has a ring threaded interface for engaging the rod threaded interface to couple the piston rod to the preload ring. A protruding end surface of the piston rod protrudes past an end face of the preload ring when the piston rod is coupled to the preload ring and the rod shoulder engages a ring shoulder of the preload ring. A piston has a pocket for receiving the preload ring. Preload ring fasteners couple the preload ring to the piston to form a piston rod connection between the piston rod and the piston, such that the protruding end surface of the piston rod engages an interior surface of the pocket and a preload is induced in the piston rod connection.

In an alternate embodiment of this disclosure, a piston rod subassembly of a blowout preventer includes a piston rod having a rod threaded interface and a rod shoulder on an outer diameter of the piston rod at a first end. A ram connector is located at a second end that is opposite of the first end. A preload ring has a ring threaded interface for engaging the rod threaded interface to couple the piston rod to the preload ring. A protruding end surface of the piston rod protrudes past an end face of the preload ring when the piston rod is coupled to the preload ring and the rod shoulder engages a ring shoulder of the preload ring. A piston has a pocket for receiving the preload ring. The piston also has an outer diameter seal selectively engaging an inner diameter of a piston chamber of a bonnet assembly of the blowout preventer and is moveable within the piston chamber between an extended position and a retracted position. The piston further has a tail rod, the tail rod being a threaded elongated member extending in a direction opposite from the piston rod and threadingly engaging the bonnet assembly of the blowout preventer and inducing a rotation in the piston when the piston moves between the extended position and the retracted position. Preload ring fasteners couple the preload ring to the piston to form a piston rod connection between the piston rod and the piston, such that the protruding end surface of the piston rod engages an interior surface of the pocket and a preload is induced in the piston rod connection.

In yet another alternate embodiment of this disclosure, a method of assembling a blowout preventer with a piston rod subassembly includes providing a piston rod having a rod threaded interface and having a rod shoulder on an outer diameter of the piston rod. The piston rod is threaded into a preload ring. The preload ring has a ring threaded interface for engaging the rod threaded interface to couple the piston rod to the preload ring. A protruding end surface of the piston rod protrudes past an end face of the preload ring when the piston rod is coupled to the preload ring and the rod shoulder engages a ring shoulder of the preload ring. The preload ring can be located in a pocket of a piston. The preload ring can be coupled to the piston with preload ring fasteners to form a piston rod connection between the piston rod and the piston, such that the protruding end surface of the piston rod engages an interior surface of the pocket and a preload is induced in the piston rod connection.

BRIEF DESCRIPTION OF THE DRAWINGS

So that the manner in which the features, advantages and objects of this disclosure, as well as others which will become apparent, are attained and can be understood in more detail, more particular description of the disclosure briefly summarized above may be had by reference to the embodiment thereof which is illustrated in the appended drawings, which drawings form a part of this specification. It is to be noted, however, that the drawings illustrate only a preferred embodiment of the disclosure and is therefore not to be considered limiting of its scope as the disclosure may admit to other equally effective embodiments.

DETAILED DESCRIPTION OF THE DISCLOSURE

Figure 1:
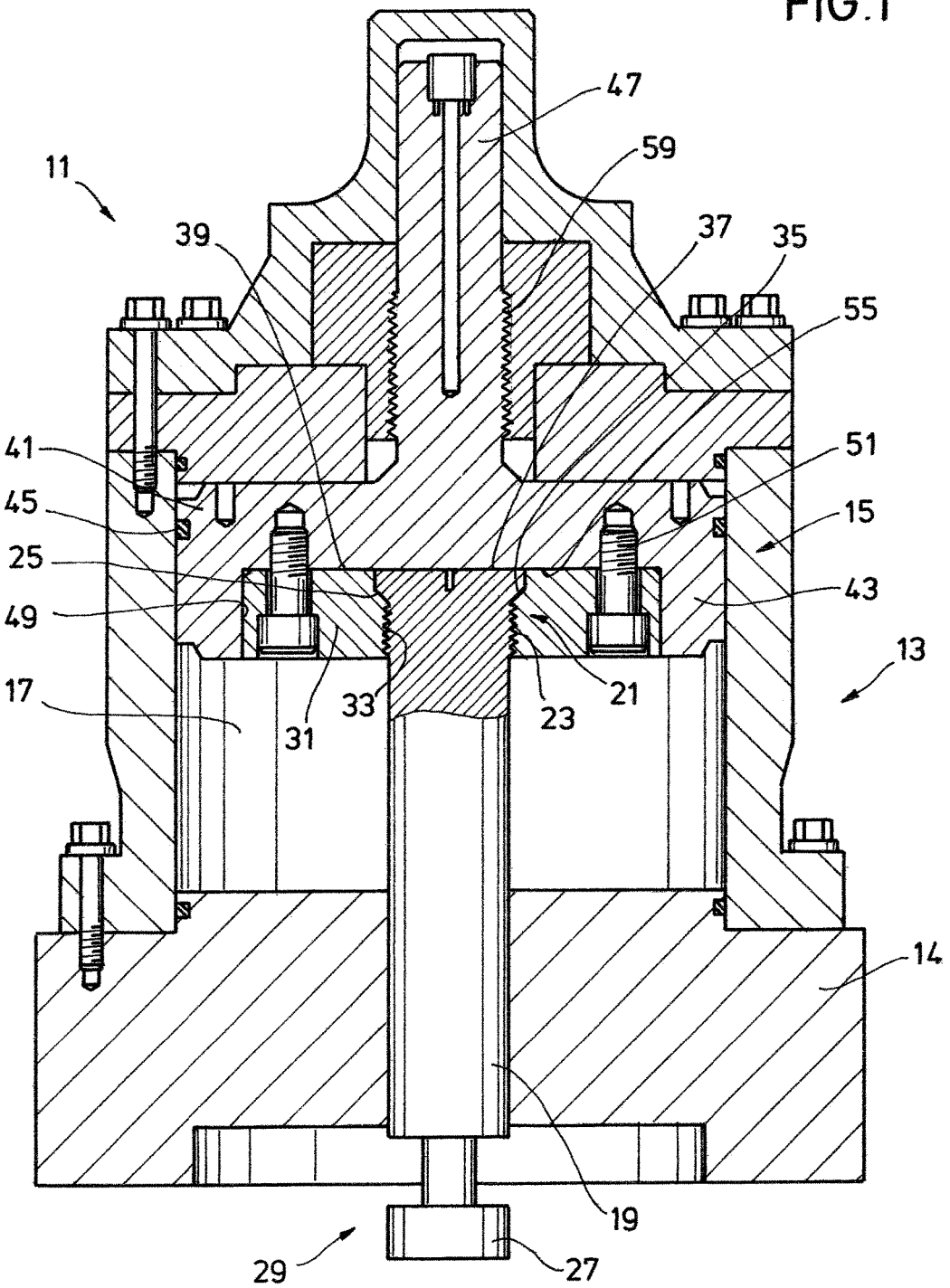
FIG. 1 is a partial, cross sectional view of an operator piston rod subassembly installed within an operator of a blowout preventer in accordance with an example embodiment of the present disclosure.

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, ram blowout preventer operator assembly 11 is a part of an assembly that is secured to bonnet 14 of bonnet assembly 13. Ram blowout preventer operator assembly 11 can be used to control fluids flowing into and out of a wellbore of a subterranean well, or to control axial or rotational movement of a member passing through the wellbore, such as a tubular member, polished rod, or equipment. Piston rod subassembly 15 is located within bonnet assembly 13 and is operably responsive to the selective introduction and removal of a pressure media entering and exiting piston chamber 17 defined within bonnet assembly 13. The pressure media can be, as an example, a hydraulic fluid, pressurized air, or other suitable fluid or gas used in pressure systems. The pressure media can be supplied by an operator or controller through one or more fluid passages that extend into piston chamber 17.

As one skilled in the art will recognize, piston rod subassembly 15 is operable to connect to a ram (not shown), such as a pipe ram, which, when activated, moves to engage and surround drillpipe and well tools to seal a wellbore. The ram may alternately be a shear ram, which, when activated, moves to engage and physically shear any member in the wellbore. The rams can further alternately be gripping rams that can engage the tubular, polished rod, or other equipment in the well to prevent axial or rotational movement of such tubular, polished rod, or other equipment in the well. Operation of an exemplary piston rod subassembly 15 and an associated ram is described in greater detail in commonly owned U.S. Pat. No. 7,699,554, which is hereby incorporated by reference herein.

Figure 2:
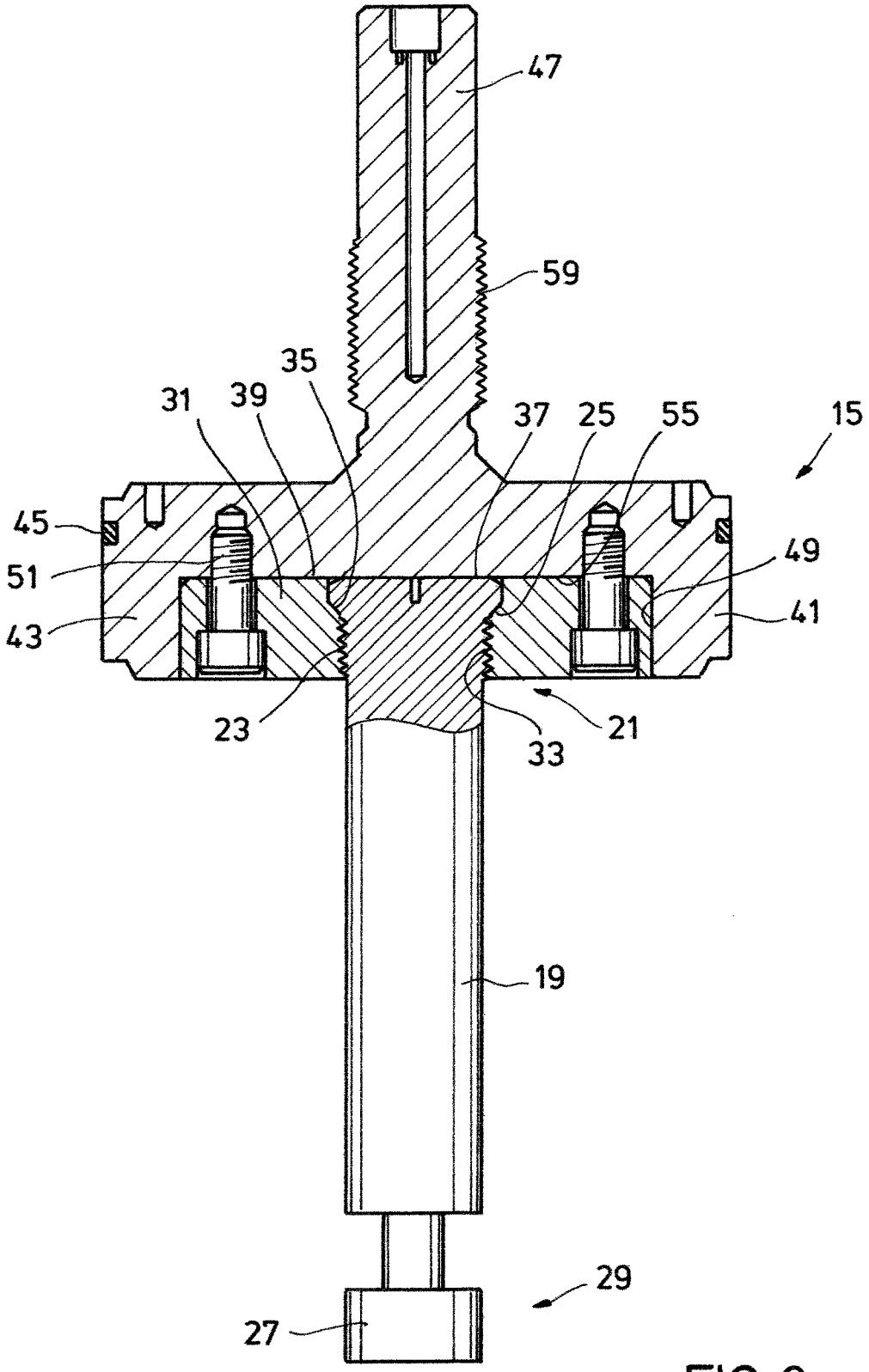
FIG. 2 is a cross-sectional view of the operator piston rod subassembly of FIG. 1.

Looking at FIG. 2, piston rod subassembly 15 is constructed of piston rod 19 with a first end 21 having a rod threaded interface 23. Rod threaded interface 23 includes threads on an outer diameter of piston rod 19. First end 21 also has rod shoulder 25 on an outer diameter of piston rod 19. Rod shoulder 25 is an annular sloped surface that flares outward and faces towards rod threaded interface 23. The annular sloped surface defines an increase in the outer diameter of piston rod 19. Piston rod 19 has ram connector 27 on a second end 29 of piston rod 19. Second end 29 of piston rod 19 can extend into bonnet 14 of blowout preventer operator assembly 11 and be configured for connecting to a ram (not shown) having a T-slot defined therein. Ram connector 27 can be restrained by the ram so that ram connector 27 and second end 29 of piston rod cannot rotate about a longitudinal axis of piston rod 19. Piston rod 19 can be formed, for example, of an alloy.

Figure 3:
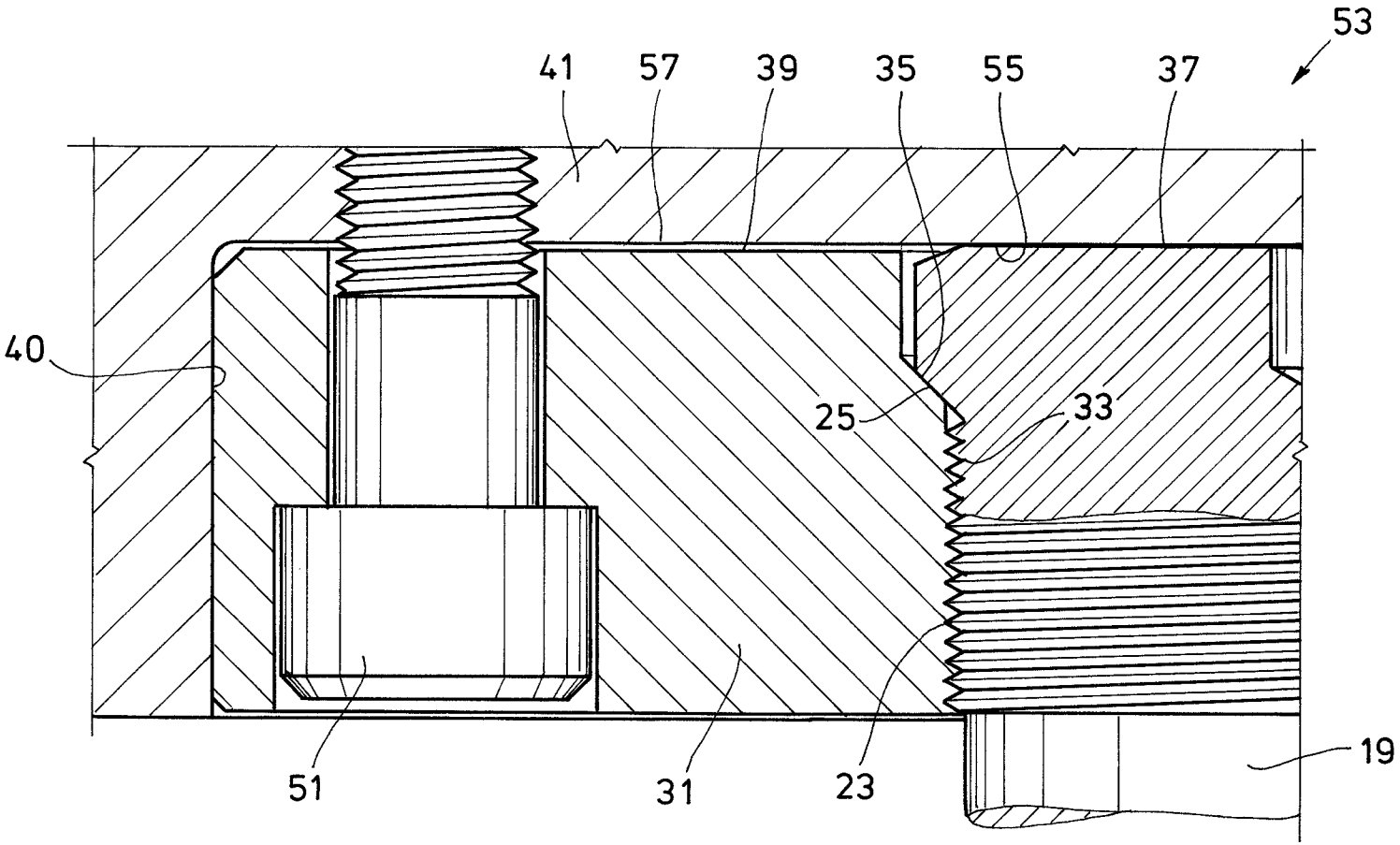
FIG. 3 is a detail cross-sectional view of a portion of the operator piston rod subassembly of FIG. 2.

The first end 21 of piston rod 19 can be coupled with preload ring 31. Preload ring 31 has ring threaded interface 33 for engaging rod threaded interface 23 to couple piston rod 19 to preload ring 31. Ring threaded interface 33 can include internal threads on an inner diameter of a bore that extends through preload ring 31. Preload ring 31 has a ring shoulder 35 that is positioned and shaped to engage and mate with rod shoulder 25. Ring shoulder 35 is a sloped annular shoulder on an inner surface of the bore of preload ring 31. Ring shoulder 35 is positioned within the bore of preload ring 31 so that when piston rod 19 is coupled to preload ring 31 and rod shoulder 25 engages ring shoulder 35, end surface 37 of piston rod 19 protrudes past end face 39 of preload ring 31 (FIG. 3).

Preload ring 31 can be coupled to piston 41. Piston 41 has piston body 43 with an outer diameter seal 45 that can sealingly and slidingly engage an inner diameter of piston chamber 17. By injecting the pressure media into piston chamber 17 on a first side of piston body 43, piston rod subassembly 15 can be moved within piston chamber 17 from a retracted position to an extended position. By injecting the pressure media into piston chamber 17 on a second side of piston body 43, piston rod subassembly 15 can be moved within piston chamber 17 from the extended position to the retracted position. When piston 41 and piston rod subassembly 15 are in the retracted position, second end 29 of piston rod 19 is proximate to or closer to bonnet assembly 13. When piston 41 and piston rod subassembly 15 are in the extended position, second end 29 of piston rod 19 is extended away from, and farther from, bonnet assembly 13 so that the rams extend into the wellbore.

Piston 41 also has tail rod 47. Tail rod 47 can be a threaded elongated member extending in a direction opposite from the piston rod 19. Tail rod 47 can be an integrally formed portion of piston 41 so that tail rod 47 and piston body 43 are a single member. Piston 41 and preload ring 31 can be formed of a material that is less expensive than used to form piston rod 19. Piston 41 and preload ring 31 can be formed, as an example, from a steel material.

Piston 41 further has pocket 49 for receiving preload ring 31. Preload ring fasteners 51 can couple preload ring 31 to piston 41 to complete piston rod connection 53 between piston rod 19 and piston 41, as can best be seen in FIG. 3. In the example embodiments shown, preload ring fasteners 51 can extend through preload ring 31 to engage piston 41. Preload ring fasteners 51 can include, as an example, an annular array of cap screws. Because end surface 37 of piston rod 19 protrudes past end face 39 of preload ring 31, end surface 37 of piston rod 19 engages interior surface 55 of pocket 49 and at least a portion of end face 39 of the preload ring 31 is spaced apart from interior surface 55 of pocket 49 forming gap 57. This helps to ensure that operational loads travel appropriately through the piston rod 19.

When preload ring fasteners 51 couple preload ring 31 to piston 41 a preload is induced in piston rod connection 53. At least a portion of end face 39 of the preload ring 31 is spaced apart from interior surface 55 of pocket 49 so that gap 57 remains during the preloading of piston rod connection 53. Piston rod connection 53 includes: the coupling of piston rod 19 to preload ring 31 through ring threaded interface 33 engaging rod threaded interface 23; preload ring fasteners 51 coupling preload ring 31 to piston 41; rod shoulder 25 engaging ring shoulder 35; and end surface 37 of piston rod 19 engaging interior surface 55 of pocket 49. Preload ring fasteners 51 will be acting to pull preload ring 31 towards piston 41, while end surface 37 of piston rod 19 engaging interior surface 55 of pocket 49 will be resisting such pull. The pull of preload ring 31 towards piston 41 will also apply a load on the interface between preload ring 31 and piston rod 19, such interface being ring threaded interface 33 engaging rod threaded interface 23 and rod shoulder 25 engaging ring shoulder 35. The preloading of piston rod connection 53 will help to ensure that the components of piston rod connection 53 will remain well secured together throughout the operation of piston rod subassembly 15 within blowout preventer operator assembly 11.

Tail threads 59 of tail rod 47 threadingly engage internal threads of blowout preventer operator assembly 11. The threads of the blowout preventer operator assembly 11 can be part of a nut and clutch assembly that can allow the threads of the blowout preventer operator assembly 11 to rotate freely when piston 41 moves between the extended position and the retracted position through injection of the pressure media into piston chamber 17. Therefore, when piston 41 moves between the extended position and the retracted position through injection of the pressure media into piston chamber 17, the nut can rotate around tail threads 59 without inducing a rotation on piston 41. The nut and clutch assembly allows piston 41 to be locked at various locations along the linear path, as needed during operation. When the nut and clutch assembly is engaged, which occurs when operator pressure is vented, piston 41 is locked. When there is pressure in the wellbore, a pressure end load is applied to second end 29 of piston rod 19. This pressure end load urges piston rod subassembly 15 towards a retracted position. Because second end 29 of piston rod 19 cannot rotate about the longitudinal axis of piston rod 19, and the nut and clutch assembly is engaged, linear movement of piston 41 induces a torque on piston rod connection 53.

Tail threads 59 of tail rod 47 can be oriented in an opposite direction than threads of rod threaded interface 23 so that rotation of piston 41 causes threaded interface 33 and rod threaded interface 23 to rotate relative to each other so that rod shoulder 25 further engages ring shoulder 35. In this way, the connection between preload ring 31 and piston rod 19 will tend to further tighten when pressure end load urges piston rod subassembly 15 towards a retracted position. Because of the mating of rod shoulder 25 with ring shoulder 35, piston rod 19 cannot be rotated out of preload ring 31 and piston rod connection 53 will remain secure during the operation of blowout preventer operator assembly 11. In this way, rod shoulder 25 acts as an anti-rotation device so that piston rod 19 cannot be rotated out of preload ring 31.

In order to maintain piston rod subassembly 15 or replace or salvage parts of piston rod subassembly 15, preload ring fasteners 51 are operable to release preload ring 31 from piston 41 with a hand tool at the site of blowout preventer operator assembly 11 to relieve the preload in piston rod connection 53. No machining, permanent removal of material of piston rod assembly 15, or other destruction of the components of piston rod assembly 15 is required to disassemble each of the parts of piston rod assembly 15.

In an example of operation, in order to assemble blowout preventer operator assembly 11 with piston rod subassembly 15, second end 29 of piston rod 19 can be fed through the bore that extends through preload ring 31 and piston rod 19 can be rotated so that ring threaded interface 33 engages rod threaded interface 23 to couple piston rod 19 to preload ring 31. Piston rod 19 can be rotated until ring shoulder 35 engages and mates with rod shoulder 25. When ring shoulder 35 engages and mates with rod shoulder 25 end surface 37 of piston rod 19 protrudes past end face 39 of preload ring 31. Preload ring 31 can then be located within pocket 49 and preload ring fasteners 51 can couple preload ring 31 to piston 41. Protruding end surface 37 of piston rod 19 will engage interior surface 55 of pocket 49 and a preload will be induced in piston rod connection 53. Preload ring fasteners 51 can cause a sufficient force on preload ring 31 that preload ring 31 can be deformed during the preloading of piston rod connection 53.

During operation of blowout preventer operator assembly 11, piston rod subassembly 15 moves between the retracted and extended positions by injecting pressure media into piston chamber 17 on a first side of piston body 43 or on a second side of piston body 43, as applicable. When piston 41 moves between the retracted and extended positions, the nut and clutch assembly can allow the threads of the blowout preventer operator assembly 11 to rotate freely so that the nut can rotate around tail threads 59 without inducing a rotation on piston 41.

In order to maintain piston rod subassembly 15 or replace or salvage parts of piston rod subassembly 15, preload ring fasteners 51 are operable to release preload ring 31 from piston 41, such as, for example, with a hand tool at the site of blowout preventer operator assembly 11 to relieve the preload in piston rod connection 53. Therefore, if blowout preventer operator assembly 11 is used offshore, piston rod subassembly 15 can be disassembled offshore and without sending the entire piston rod subassembly 15 to an onshore location for the disassembly. Also, since no machining is required, the components of piston rod subassembly 15 can be more easily salvaged when components are replaced or maintained.

Therefore, as described herein, embodiments of this disclosure simplify the assembly and disassembly of piston rod assembly 15 compared to some current systems by eliminating the need for extra fixtures to induce and break the preload of piston rod connection 53, as well as by eliminating the need for machining to separate the parts of piston rod assembly 15. System and methods described herein also reduce material costs of piston rod subassembly 15 by providing embodiments that require that only piston rod 19 be formed of an expensive alloy, while the remainder of piston rod subassembly 15 can be formed of a simple steel.

The terms "vertical", "horizontal", "upward", "downward", "top", and "bottom" are used herein only for convenience because blowout preventer operator assembly 11 may be installed in various positions.

System and methods described herein, therefore, are well adapted to carry out the objects and attain the ends and advantages mentioned, as well as others inherent therein. While a presently preferred embodiment has been given for purposes of disclosure, numerous changes exist in the details of procedures for accomplishing the desired results. These and other similar modifications will readily suggest themselves to those skilled in the art, and are intended to be encompassed within the spirit of this disclosure and the scope of the appended claims.

What is claimed is:

1. A piston rod subassembly for use in a blowout preventer operator assembly, the piston rod subassembly comprising:

a piston rod having a rod threaded interface and having a rod shoulder on an outer diameter of the piston rod;

a preload ring having a ring threaded interface for engaging the rod threaded interface to couple the piston rod to the preload ring, wherein a protruding end surface of the piston rod protrudes past an end face of the preload ring when the piston rod is coupled to the preload ring and the rod shoulder engages a ring shoulder of the preload ring;

a piston having a pocket for receiving the preload ring; and preload ring fasteners for coupling the preload ring to the piston to form a piston rod connection between the piston rod and the piston, such that the protruding end surface of the piston rod engages an interior surface of the pocket and a preload is induced in the piston rod connection.

2. The piston rod subassembly according to claim 1, wherein at least a portion of the end face of the preload ring is spaced apart from the interior surface of the pocket when the preload is induced in the piston rod connection.

3. The piston rod subassembly according to claim 1, wherein the piston is formed of a steel material.

4. The piston rod subassembly according to claim 1, wherein the piston has a tail rod, the tail rod being a threaded elongated member extending in a direction opposite from the piston rod, and wherein threads of the tail rod are oriented in an opposite direction than threads of the rod threaded interface.

5. The piston rod subassembly according to claim 1, wherein the piston has a tail rod, the tail rod being a threaded elongated member extending in a direction opposite from the piston rod so that an end load pressure on the piston induces a torque on the piston rod connection.

6. The piston rod subassembly according to claim 5, wherein threads of the tail rod are oriented so that the torque causes the rod shoulder to further engage the ring shoulder of the preload ring.

7. The piston subassembly according to claim 1, wherein the piston has an integrally formed tail rod, the tail rod being a threaded elongated member extending in a direction opposite from the piston rod and being formed of a steel material.

8. The piston rod subassembly according to claim 1, wherein the preload ring fasteners are operable to release the preload ring from the piston with a hand tool to relieve the preload in the piston rod connection.

9. A piston rod subassembly of a blowout preventer operator assembly, the piston rod subassembly comprising:

a piston rod having a rod threaded interface and a rod shoulder on an outer diameter of the piston rod at a first end, and having a ram connector at a second end that is opposite of the first end;

a preload ring having a ring threaded interface for engaging the rod threaded interface to couple the piston rod to the preload ring, wherein a protruding end surface of the piston rod protrudes past an end face of the preload ring when the piston rod is coupled to the preload ring and the rod shoulder engages a ring shoulder of the preload ring;

a piston with a pocket for receiving the preload ring, the piston having an outer diameter seal selectively engaging an inner diameter of a piston chamber of a bonnet assembly of the blowout preventer operator assembly and being moveable within the piston chamber between an extended position and a retracted position, the piston further having a tail rod, the tail rod being a threaded elongated member extending in a direction opposite from the piston rod and threadingly engaging the bonnet assembly and inducing a rotation in the piston when an end load urges the piston towards the retracted position; and preload ring fasteners for coupling the preload ring to the piston to form a piston rod connection between the piston rod and the piston, such that the protruding end surface of the piston rod engages an interior surface of the pocket and a preload is induced in the piston rod connection.

10. The piston rod subassembly according to claim 9, wherein threads of the tail rod are oriented in an opposite direction than threads of the rod threaded interface.

11. The piston rod subassembly according to claim 9, wherein threads of the tail rod are oriented so the rotation in the piston causes the rod shoulder to further engage the ring shoulder of the preload ring as the piston moves to the extended position.

12. The piston rod subassembly according to claim 9, wherein at least a portion of the end face of the preload ring is spaced apart from the interior surface of the pocket when the preload is induced in the piston rod connection.

13. The piston subassembly according to claim 9, wherein the tail rod is an integrally formed portion of the piston and the piston is formed of a steel material.

14. A method of assembling a blowout preventer operator assembly with a piston rod subassembly, the method comprising:

providing a piston rod having a rod threaded interface and having a rod shoulder on an outer diameter of the piston rod;

threading the piston rod into a preload ring having a ring threaded interface for engaging the rod threaded interface to couple the piston rod to the preload ring, wherein a protruding end surface of the piston rod protrudes past an end face of the preload ring when the piston rod is coupled to the preload ring and the rod shoulder engages a ring shoulder of the preload ring;

locating the preload ring in a pocket of a piston; and coupling the preload ring to the piston with preload ring fasteners to form a piston rod connection between the piston rod and the piston, such that the protruding end surface of the piston rod engages an interior surface of the pocket and a preload is induced in the piston rod connection.

15. The method according to claim 14, wherein at least a portion of the end face of the preload ring is spaced apart from the interior surface of the pocket when the preload is induced in the piston rod connection.

16. The method according to claim 14, wherein the piston has a tail rod, the tail rod being a threaded elongated member extending in a direction opposite from the piston rod, and wherein threads of the tail rod are oriented in an opposite direction than threads of the rod threaded interface, the method further comprising generating a torque on the piston rod connection when an end load acts on the piston.

17. The method according to claim 14, wherein the piston has a tail rod, the tail rod being a threaded elongated member extending in a direction opposite from the piston rod, the method further comprising inducing a torque on the piston rod connection when an end load acts on the piston.

18. The method according to claim 17, wherein threads of the tail rod are oriented so that the step of inducing the torque on the piston rod connection causes the rod shoulder to further engage the ring shoulder of the preload ring.

19. The method according to claim 14, further comprising releasing the preload ring from the piston with a hand tool to relieve the preload in the piston rod connection.

20. The method according to claim 14, wherein the step of coupling the preload ring to the piston with the preload ring fasteners includes deforming the preload ring to induce the preload in the piston rod connection.

* * * * *